US009428002B2

(12) United States Patent
Rosenberg

(10) Patent No.: US 9,428,002 B2
(45) **Date of Patent: *Aug. 30, 2016**

(54) DEFENSIVE WRITING INSTRUMENT

(71) Applicant: Samuel Rosenberg, Glenshaw, PA (US)

(72) Inventor: Samuel Rosenberg, Glenshaw, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/795,612

(22) Filed: Jul. 9, 2015

(65) Prior Publication Data

US 2015/0306901 A1 Oct. 29, 2015

Related U.S. Application Data

(63) Continuation of application No. 12/136,490, filed on Jun. 10, 2008, now Pat. No. 9,108,454.

(51) Int. Cl.

| | |
|---|---|
| ***B43K 29/00*** | (2006.01) |
| ***B43K 29/18*** | (2006.01) |
| ***B43K 23/08*** | (2006.01) |
| ***B43K 29/10*** | (2006.01) |

(52) U.S. Cl.

CPC ..... *B43K 29/18* (2013.01); *B43K 23/08* (2013.01); *B43K 29/00* (2013.01); *B43K 29/004* (2013.01); *B43K 29/10* (2013.01)

(58) Field of Classification Search

CPC .... B43K 29/18; B43K 29/10; B43K 29/004; B43K 23/08

USPC ..... 401/195, 52; 30/366, 367

See application file for complete search history.

(56) References Cited

U.S. PATENT DOCUMENTS

| | | | | |
|---|---|---|---|---|
| 1,546,715 | A | 7/1925 | Calvento | |
| 4,268,926 | A | 5/1981 | Roxton | |
| 4,592,467 | A | 6/1986 | Lechner | |
| 4,752,072 | A | 6/1988 | Parsons | |
| 4,974,982 | A | 12/1990 | Nielson | |
| 5,638,566 | A | 6/1997 | Wu | |
| 6,223,441 | B1 * | 5/2001 | Parsons | A62B 3/005 30/366 |
| 6,439,734 | B1 | 8/2002 | Lo | |
| 6,640,450 | B2 | 11/2003 | Teague | |
| 7,029,193 | B1 | 4/2006 | Chao | |
| 7,080,951 | B2 | 7/2006 | Lin | |

OTHER PUBLICATIONS

Coast LED-Lenser LL7302 Pen Red Laser Pointer & Keychain 3 in 1 Pen Light http://www.quality-items-flashlights.com/product_info.php/info/p11332_Coast--LED-Lenser--LL7302-Pen-R.

"Sharkie" marker by Cold Steel http://www.coldsteel.com/91sp.html.

Home page of the Surefire website as it existed on Apr. 5, 2008, as saved on the "Wayback Machine" Internet archive, https://web.archive.org/web/20080404201541/http://www.sur.

(Continued)

*Primary Examiner* — Jennifer C Chiang

(74) *Attorney, Agent, or Firm* — William F. Lang, IV; Lang Patent Law LLC

(57) ABSTRACT

A writing instrument includes a glass break on the end opposite the writing tip. The body of the writing instruments may include circumferential ridges or channels. Some examples of the writing instrument may include a cover removably secured over the glass break, possibly with a key ring attached. A light source or laser pointer may also be included.

15 Claims, 2 Drawing Sheets

(56) References Cited

OTHER PUBLICATIONS

Home page of the Surefire website as it existed on Jun. 9, 2008, as saved on the "Wayback Machine" Internet archive, https://web.archive.org/web/20080702074512/http://www.sure.
Page of the Surefire website describing the Surefire pen, as it existed on Jun. 9, 2008, as saved on the Wayback machine Internet archive, https://web.archive.org/web/2008070.
"Wayback Machine" page showing that the Surefire website was saved on Apr. 5, 2008 and Jun. 9, 2008, https://web.archive.org/web/20080701000000*/http://www.surefire.com.
"Modular Kubaton" by Rick Hinderer Knives http://www.rickhindererknives.com/Modular%20kubatons/index.html.
"Titanium Extreme Duty Pen" by Rick Hinderer Knives http://www.rickhindererknives.com/Titanium%20Extreme%20duty%20pen/index.html.
"Aluminum Extreme Duty Pen" by Rick Hinderer Knives http://www.rickhindererknives.com/Aluminum%20Extreme%20duty%20pen/index.html.
Benchmade 1100 Pen Series http://www.benchmade.com/products/product_detail.aspx?model=1100.
"Mil-Tac Tactical Defense Pen" (Allen Elishewitz design) sold by Brigade Quartermasters http://www.actiongear.com/cgi-bin/tame.exe/agcatalog/level4s.tam?xax=8080&M5COPY%2Ectx=.
Coast LED-Lenser LL7572 Pisa LED Light Pen for desk, pocket http://www.guality-items-flashlights.com/product_info.php/info/p11736_Coast--LED-Lenser--LL7572-Pisa-LED-Light-Pen-.

* cited by examiner

DEFENSIVE WRITING INSTRUMENT

CROSS REFERENCE TO RELATED APPLICATION

This application is a continuation of U.S. patent application Ser. No. 12/136,490, filed on Jun. 10, 2008, and entitled "Defensive Writing Instrument."

TECHNICAL FIELD

The present invention relates to personal safety devices. More specifically, the invention provides a writing instrument having features that may be useful in a variety of emergency situations.

BACKGROUND INFORMATION

It is possible for an individual to face numerous types of unexpected emergencies or other potentially difficult situations during the course of any given day. These situations potentially include the need to defend against criminal attack, a need to break automobile glass to rescue an accident victim or to free oneself from a vehicle that has been involved in an accident, or a need to see while moving or working in the dark. Despite the foreseeability of the potential for these situations to occur, people are often unprepared to deal with them. Defensive or rescue equipment can be heavy or bulky, or may be subject to legal restrictions.

Writing instruments such as pens are commonly carried. These writing instruments often have little bulk, and may legally be carried virtually anywhere, ensuring that a means for dealing with an emergency is present when needed. Efforts have therefore been made to provide pens with some defensive capability. Presently available pens include the "Extreme Duty Pen" and "Modular Kubaton" (KUBOTAN is a registered trademark owned by Takayuki Kubota) sold by Rick Hinderer Knives, as well as pens offered by Benchmade and by Allen Elishewitz. All of these presently available pens lack the ability to combine a glass break with a means for securing the pen's cap or other cover over the glass break. Furthermore, some presently available pens include a point opposite the writing tip that is sufficiently sharp to present a potential to break the skin upon execution of a strike, minimizing the usefulness of these pens for nonlethal control techniques. Lastly, these pens failed to provide the ability to modify the appearance or functionality of this end of the pen while retaining an optimal striking surface.

Accordingly, there is a need for a writing instrument having a striking tip opposite the writing point, and having a means for securing a cap or other cover over the striking tip.

SUMMARY

A writing instrument includes a tubular body having a writing tip at one end, and a glass break at the other end. Means for securing a cap to either end of the body, selectively covering either the writing tip or glass break, are provided.

BRIEF DESCRIPTION OF THE DRAWINGS

Like reference characters denote like elements throughout the drawings.

DETAILED DESCRIPTION

Figure 1:
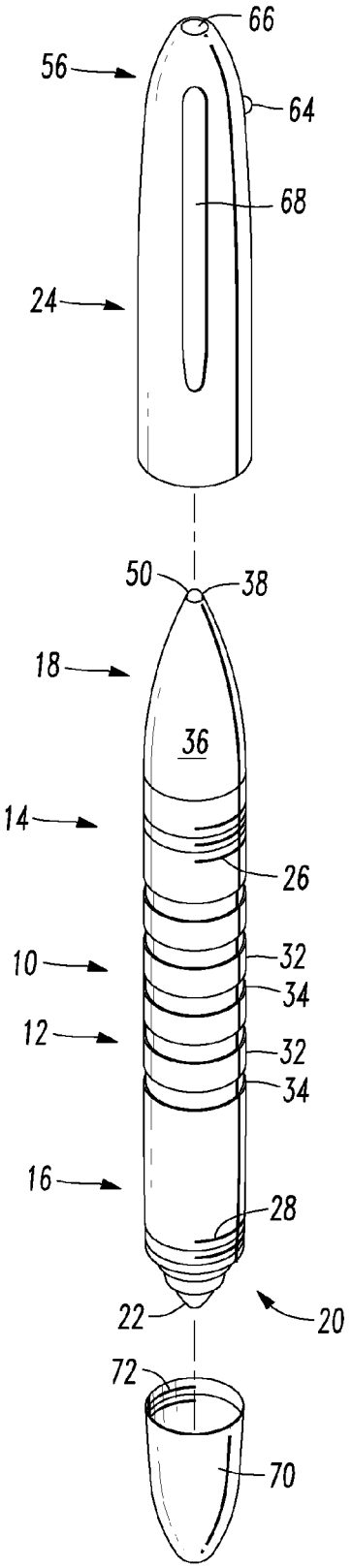
FIG. 1 is a front isometric view of an embodiment of a writing instrument.
Figure 2:
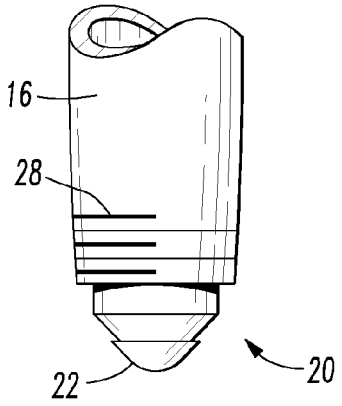
FIG. 2 is a front view of a glass break for the writing instrument of FIG. 1.

Referring to the drawings, an example of a writing instrument having defensive and/or safety features is illustrated. As shown in FIG. 1, the illustrated example of the writing instrument 10 is a pen, but other writing instruments, for example, pencils or markers, may be used. The writing instrument 10 includes a body 12 having a generally tubular structure with a first end 14 and second end 16. The first end 14 has a writing tip 18 (described in greater detail below) secured thereto. The second end 16 has a glass break 20 secured thereto, illustrated in FIGS. 1 and 2. As used herein, the term "glass break" refers to a striking tip made from a rigid, substantially completely solid, impact resistant material and having a blunt, rounded surface 22 that is structured to concentrate the force of an impact over a small surface area without creating a substantial risk of penetrating skin.

Figure 6:
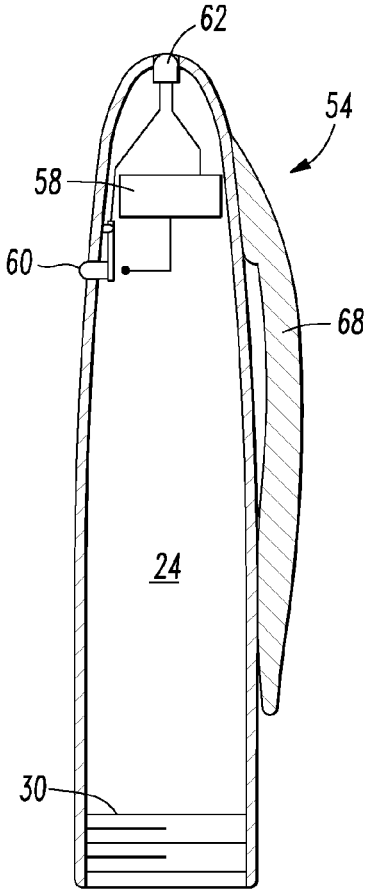
FIG. 6 is a cutaway side view of a cap for the writing instrument of FIG. 1.

The first end 14 and second end 16 include a means for securing a cap 24 to the body 12, so that the cap 24 may cover either the writing tip 18 or glass break 20. In the illustrated example, screw threads 26, 28 are provided on the first end 14 and second end 16, respectively. The illustrated example of a cap 24 (FIGS. 1, 6) includes screw threads 30 structured to intermesh with both the screw threads 26 and screw threads 28.

The illustrated example of the body 12 includes a plurality of circumferential ridges 32 and/or channels 34. These ridges 32 and/or channels 34 resist any slipping movement of the hand on the writing instrument 10 during use, and may also increase the effectiveness of pain compliance holds, as explained in more detail below.

Figure 3:
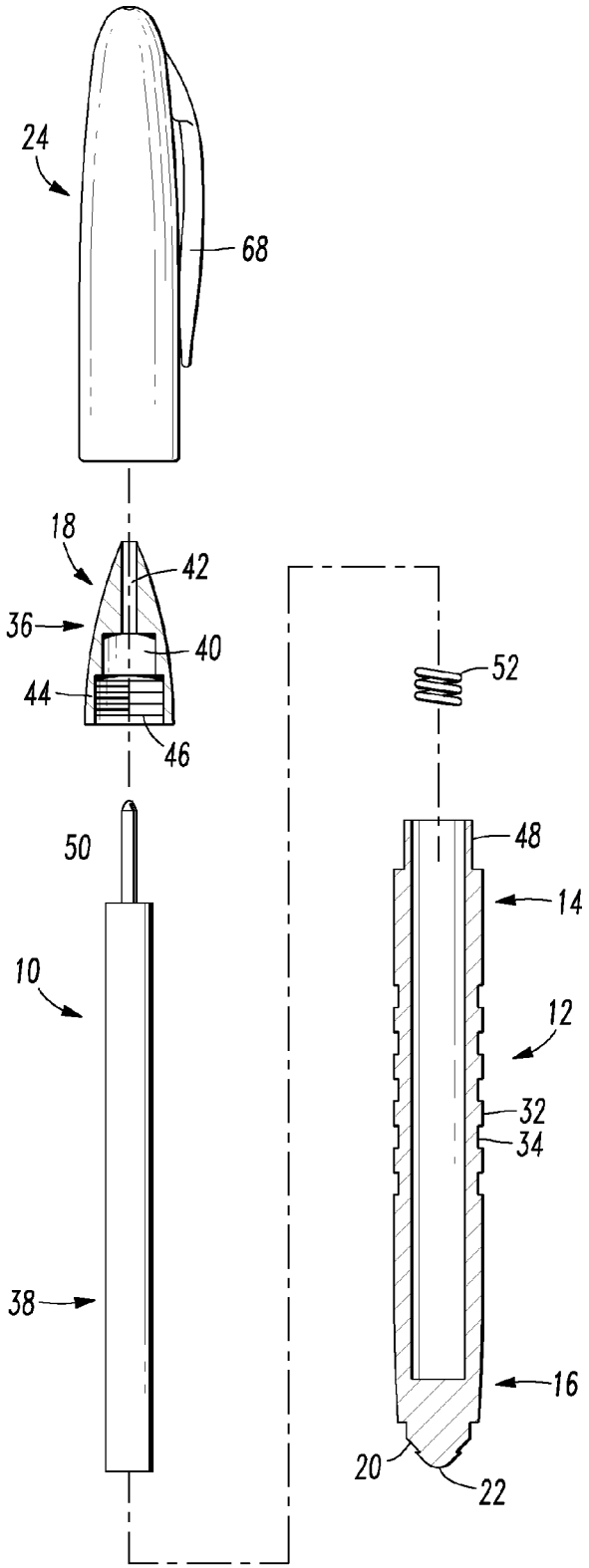
FIG. 3 is a partially cutaway side exploded view of the writing instrument of FIG. 1.

Referring to FIG. 3, an example of the writing tip 18 and associated structures is illustrated. The illustrated example of the writing tip 18 includes an insert securing member 36 that is structured to be secured to the first end 14 of the body 12, and a writing medium insert 38 In the illustrated example of a pen, the insert securing member 36 has a generally tubular, generally frustoconical configuration. As used herein, generally frustoconical may include configurations that are convex and/or bullet shaped. A channel 40 having a narrow portion 42 and wide portion 44 passes through the insert securing member 36. The wide portion 44 includes a means for securing the insert securing member 36 to the first end 14 of the body 12, which in the illustrated example include the screw threads 46 structured to intermesh with the screw threads 48 defined on the first end 14 of the body 12. The narrow portion 42 is structured to permit the tip 50 of the writing medium 38 to pass therethrough.

The writing medium insert 38 may be any insert that is appropriate to the type of writing instrument selected. In the illustrated example of a pen, the writing medium insert 38 may be any presently available ink cartridge, for example, a ballpoint pen and ink cartridge, a rollerball ink cartridge, or fountain pen ink cartridge (with an appropriate securing member 36). A preferred ink cartridge is the cartridge used by the SPACE PEN sold by the Fisher Pen Company located in Boulder City, Nev. In the case of other writing instruments, the writing medium insert 38 may be a graphite stick for use in a pencil, an ink cartridge for a marker, etc. A spring 52 may optionally be provided within a second end 16 of the body 12 to bias the writing medium insert 38 towards the first end 14 of the body 12.

Referring back to FIGS. 1 and 6, the cap 24 may include a flashlight 54 (FIG. 6) or a laser pointer 56 (FIG. 1). The flashlight 54 includes a power supply 58 that may be in the form of a replaceable or a rechargeable battery, a switch 60 which in the illustrated example is a pushbutton switch, and a light source 62 which in the illustrated example is a light emitting diode. The switch 60 may be of a type that provides for either momentary activation when pressed, or constant activation until actuated a second time to deactivate the light. Push button, sliding, or other conventional switches may be used. Alternatively, the laser pointer 56 includes a switch 64 and laser emitter 66. Laser pointers are known to those skilled in the art, and therefore not described in further detail. A pocket clip 68 is provided to secure the writing instrument 10 within a user's pocket. Although the illustrated pocket clip 68 is provided on the cap 24, the pocket clip 68 may alternatively be provided on the body 12.

Figure 4:
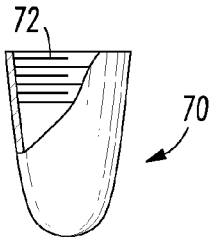
FIG. 4 is a partially cutaway front view of a glass break cover for the writing instrument of FIG. 1.
Figure 5:
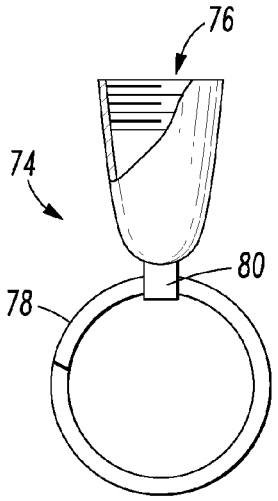
FIG. 5 is a partially cutaway front view of an alternative glass break cover for the writing instrument of FIG. 1.

The writing instrument 10 may include a cover that is structured to be secured over the glass break 20. One possible cover 70 is illustrated in FIG. 4. The cover 70 is a generally bullet shaped cover having an internally threaded opening 72 structured to intermesh with the screw threads 28. The external configuration of the cover 70 is intended to continue the lines and general appearance of the writing instrument 10 so that it appears to be one piece with the writing instrument 10. The cover 70 therefore provides the writing instrument 10 with a more benign appearance, which may be desirable in some business environments. Another alternative cover is the key ring cover 74 illustrated in FIG. 5. The key ring cover 74 has a generally bullet shaped external configuration, corresponding to the lines and general appearance of the writing instrument 10, in a manner similar to the cover 70. The key ring cover 74 is also provided with an internally threaded hole 76 that is structured to fit the screw threads 28 on the second end 16 of the body 12. The tip of the key ring cover 74 is provided with a keyring 78, which in the illustrated example is secured to the key ring cover 74 by a swivel 80, maximizing the freedom of movement of the keyring 78 with respect to the cover 74.

In use, the writing instrument 10 may be carried in any manner that is convenient to the user. Some users may wish to clip the writing instrument 10 to a shirt or jacket pocket, while others may wish to utilize a cover 74 to attach their keys to the writing instrument 10, carrying the writing instrument 10 in a pocket or inside their waistband. Regardless of the selected mode of carry, the writing instrument 10 is immediately available in the event of an emergency. For example, in the event of criminal attack, the writing instrument 10 may be quickly withdrawn from a pocket, grasped with both ends protruding from the user's fist, and immediately used to block attacks by striking the attackers arm with the glass break 20, the cap 24, or the cover 70, 74. The user may then follow up by striking the attacker with these same surfaces, and/or attempt to control the attacker by applying pain compliance holds wherein the body 12 is pressed against the attacker's wrist. The ridges 32 and/or channels 34 serve to resist sliding of the writing instrument 10 within the user's hand during blocking and striking, and to increase the effectiveness of pain compliance holds by reducing the surface area over which the force of the holds are applied.

If the emergency occurs while the user is using the writing instrument 10 to write, the writing instrument and may be used as a defensive tool with substantially equal effectiveness. Because the cap 24 is firmly secured over the second end 16 of the body 12, and because the writing tip 18 is firmly secured to the first end 14 of the body 12, the cap 24 may be stored in this convenient location during use of the writing instrument 10 for writing without compromising the rigidity or general usefulness of the writing instrument 10 as a defensive tool.

If the nature of the emergency is an automobile accident, the writing instrument 10 may be quickly accessed, and the glass break 20 may be used to quickly break a vehicle window, enabling the user to quickly free himself or another accident victim from the vehicle.

If the user enters a darkened area, the user may utilize the flashlight 54 to facilitate vision, thereby avoiding any obstacles that may be present. If a criminal attack occurs in this darkened area, the writing instrument is already positioned within the user's hand, with the cap 24 protruding from the thumb end of the fist, and the glass break 20 protruding from the opposite end of the fist, already in the appropriate position for a hammer fist strike and for the above-described defensive usage. Similarly, a user who has selected a writing instrument 10 with a laser pointer 56 already has a defensive tool in hand if an attack occurs during use of the laser pointer. This capability can be particularly useful, for example, to a teacher who is responsible for the safety of his students, or to a businessman who is making a presentation during negotiations in a hostile situation, or under other less than amicable circumstances.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A personal protection writing instrument, comprising:

a generally tubular body having a first end and a second end, the generally tubular body having sufficient strength to resist deflection and breakage when utilized to apply a pain compliance hold;

a writing tip disposed on the first end of the body; and a glass break disposed on the second end of the body, the glass break being made from a rigid, substantially solid, impact resistant material and tapering towards blunt, convex end surface that is structured to resist penetration of human skin upon being utilized to deliver a blow to a human, the end surface of the glass break having a sufficiently small surface area to effectively break automobile glass when the personal protection writing instrument is gripped in a user's first and applied to the automobile glass in a hammerfist strike, the glass break having sufficient hardness to break automobile glass when the personal protection writing instrument is gripped in a user's first and applied to the automobile glass in a hammerfist strike.

2. The personal protection writing instrument according to claim 1, wherein the end surface of the glass break is substantially axially central with respect to the personal protection writing instrument.

3. The personal protection writing instrument according to claim 1, wherein the glass break is tapered towards the blunt, rounded end surface.

4. The personal protection writing instrument according to claim 1, wherein:

the first end of the generally tubular body defines a first cap securing structure; and the second end of the generally tubular body defines a second cap securing structure.

5. The personal protection writing instrument according to claim 4, wherein the first cap securing structure and second cap securing structure include threads defined on the body, structured to mate with threads defined on the open end of the cap.

6. The personal protection writing instrument according to claim 4, further comprising at least one cap having an open end and a closed end, the open end having a cap securing structure that is structured to mate with at least one of the first cap securing structure and the second cap securing structure to secure the at least one cap to either the first end of the body, covering the writing tip, or the second end of the body, covering the glass break.

7. The personal protection writing instrument according to claim 6, wherein:

the at least one cap includes at least two caps, and one of the at least two caps has a key ring attached thereto.

8. The personal protection writing instrument according to claim 7, wherein the key ring is attached to one of the at least two caps by a swivel.

9. The personal protection writing instrument according to claim 6, further comprising a light source secured within the closed end of at least one cap.

10. The personal protection writing instrument according to claim 9, wherein the light source includes a light emitting diode.

11. The personal protection writing instrument according to claim 9, wherein the light source is structured to be utilized as a flashlight with the cap secured to the body.

12. The personal protection writing instrument according to claim 6, further comprising a laser emitting device secured within the closed end of at least one cap.

13. The personal protection writing instrument according to claim 1, wherein the writing tip further comprises:

a writing medium insert disposed within the body, the writing medium insert having a tip, the writing medium insert being structured to dispense a writing medium from the tip; and an insert securing member having a wide end and an narrow end, the wide end being removably secured to the first end of the body, the insert securing member being structured to secure the writing medium insert within the body, and to permit the point of the writing medium insert to protrude from the narrow end of the insert securing member.

14. The personal protection writing instrument according to claim 13, wherein the insert securing member is threadedly secured to the body.

15. The personal protection writing instrument according to claim 1, wherein the body defines a plurality of ridges or channels thereon.

* * * * *